US011464691B1

(12) United States Patent
Razon

(10) Patent No.: US 11,464,691 B1
(45) Date of Patent: Oct. 11, 2022

(54) ASSISTED STANDING AND WALKING DEVICE WITH LATERAL GAIT CONTROL

(71) Applicant: Eli Razon, Maple Glen, PA (US)

(72) Inventor: Eli Razon, Maple Glen, PA (US)

( * ) Notice: Subject to any disclaimer, the term of this patent is extended or adjusted under 35 U.S.C. 154(b) by 71 days.

(21) Appl. No.: 17/163,489

(22) Filed: Jan. 31, 2021

Related U.S. Application Data

(60) Provisional application No. 62/970,056, filed on Feb. 4, 2020.

(51) Int. Cl.

| | |
|---|---|
| ***A61G 5/12*** | (2006.01) |
| ***A61G 5/14*** | (2006.01) |
| ***A61G 5/04*** | (2013.01) |
| ***A61G 5/02*** | (2006.01) |

(52) U.S. Cl.
CPC ..... *A61G 5/14* (2013.01); *A61G 5/025* (2013.01); *A61G 5/041* (2013.01); *A61G 5/125* (2016.11); *A61G 5/127* (2016.11); *A61G 5/128* (2016.11)

(58) Field of Classification Search
CPC ..... A61G 5/14; A61G 5/125; A61G 5/127; A61G 5/128; A61G 5/025; A61G 5/041; A61G 5/12; A61H 2003/005; A61H 3/02
USPC ..... 280/65
See application file for complete search history.

(56) References Cited

U.S. PATENT DOCUMENTS

| | | | | | |
|---|---|---|---|---|---|
| 2,678,054 | A * | 5/1954 | Bostelman | A61H 3/02 | 623/32 |
| 2,707,962 | A * | 5/1955 | Yandow | A61H 3/00 | 135/69 |
| 4,291,715 | A * | 9/1981 | Monte | A61H 3/02 | 135/68 |
| 6,799,592 | B1 * | 10/2004 | Reynolds | A45B 9/00 | 135/74 |
| 9,408,443 | B2 * | 8/2016 | Hunter | A45B 3/00 | |
| 10,624,810 | B2 * | 4/2020 | Hunter | A45B 3/00 | |
| 11,311,449 | B1 * | 4/2022 | Razon | A61H 3/0277 | |
| 2007/0012345 | A1 * | 1/2007 | Owens | A61H 3/02 | 135/69 |
| 2009/0165834 | A1 * | 7/2009 | West | A61H 3/02 | 135/65 |
| 2009/0229643 | A1 * | 9/2009 | Ramm | A61H 3/02 | 135/69 |
| 2013/0152986 | A1 * | 6/2013 | Hunter | A45B 3/00 | 135/66 |
| 2013/0184616 | A1 * | 7/2013 | Sanders | A61H 3/06 | 601/33 |
| 2013/0226058 | A1 * | 8/2013 | Sanders | A61H 3/0288 | 602/23 |
| 2014/0096804 | A1 * | 4/2014 | Keck | A61H 3/02 | 135/69 |
| 2018/0078442 | A1 * | 3/2018 | Zoss | A61H 3/008 | |

* cited by examiner

*Primary Examiner* — James A Shriver, II
*Assistant Examiner* — Hilary L Johns

(57) ABSTRACT

An assisted standing and walking device for a user with at least one side paralysis or weakness is provided with provisions for assisted transitioning of the user from a seated position to a standing position prior to walking in the assisted standing and walking device with user friendly attachment and release with controlled limitation of lateral gait movement that occurs in lateral walking gait motion.

11 Claims, 12 Drawing Sheets

Z
Y
X
90
33c
30b
33c'
30
30a''
30a
21
12
33a
22
34b'
34a
25
16
13
52
20
46
18

ASSISTED STANDING AND WALKING DEVICE WITH LATERAL GAIT CONTROL

CROSS REFERENCE TO RELATED APPLICATIONS

This application claims priority to U.S. Provisional Patent Application No. 62/970,056 filed Feb. 4, 2020, which application is incorporated herein by reference in its entirety.

FIELD OF THE INVENTION

The present invention relates to an assisted standing and walking device for a human experiencing at least one-sided partial paralysis or weakness where the device can be attached by the user without external assistance while being in a seated position and will assist the user to transition from a seated position to a standing position for walking with a simple user-friendly installation and controlled limited lateral gait movement while walking in the device.

BACKGROUND OF THE INVENTION

Human one sided paralysis (hemiplegia) or weakness (hemiparesis) is typically the result of a stroke, but can also result from other brain, nervous system and spinal cord injuries or diseases. Further one sided weakness can be the result of soft tissue injuries to one-side of the body, for example, from automobile or other types of accidents.

Assisted human ability to rise from a seated position to a standing upright position and walking with one sided paralysis or weakness, and also paraplegia or paraparesis, typically involves use of an upper limb, including the hand, axilla and shoulder up to the deltoid region and a lower limb, including the foot, lower leg and thigh up to the hip or gluteal region.

At one end of the spectrum of assisted standing and walking devices, there is a multitude of sophisticated prior art devices for at least one-sided paralysis or weakness that are difficult and time consuming to attach to the user, and may require the removal of clothing to complete their installation, or interfere with medical devices attached to the user's body.

At the other end of the spectrum of assisted standing and walking devices, there is a multitude of crutches that transfer weight from the lower extremities to the upper body and are of limited value for at least one-sided paralysis or weakness extending upwards beyond the lower extremity and are also of limited value for transitioning between seated and standing positions.

It is one object of the present invention to provide an assisted standing and walking device for a user with at least one sided paralysis or weakness extending from the upper limb to the lower limb, or at least one side region to a foot or at least one or more one side regions in between, that employs a simple user friendly installation without external assistance and provides for a controlled transitioning between a seated position and a standing position and limited lateral gait movement of the user while walking with the assisted walking device.

It is another object of the present invention to provide an assisted walking device for use by a paraplegic, which device employs a simple user-friendly installation without external assistance and provides for a controlled transitioning between a seated position and a standing position and limited lateral gait movement of the user while walking with the assisted standing and walking device.

BRIEF SUMMARY OF THE INVENTION

In one aspect the present invention is an assisted standing and walking device for a user with at least one-sided paralysis or weakness where the device has a simple user-friendly installation without external support and a simple release from the user, and where the device provides the user with a controlled transitioning between a seated position and a standing position without external support and limited lateral gait movement while walking in the device.

In another aspect the present invention is an assisted standing and walking device for use by a paraplegic where the device has a simple user-friendly installation without external support and a simple release from the user, and where the device provides the user with a controlled transitioning between a seated position and a standing position and lateral gait movement while walking in the device.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims.

DETAILED DESCRIPTION OF THE INVENTION

Figure 1A:
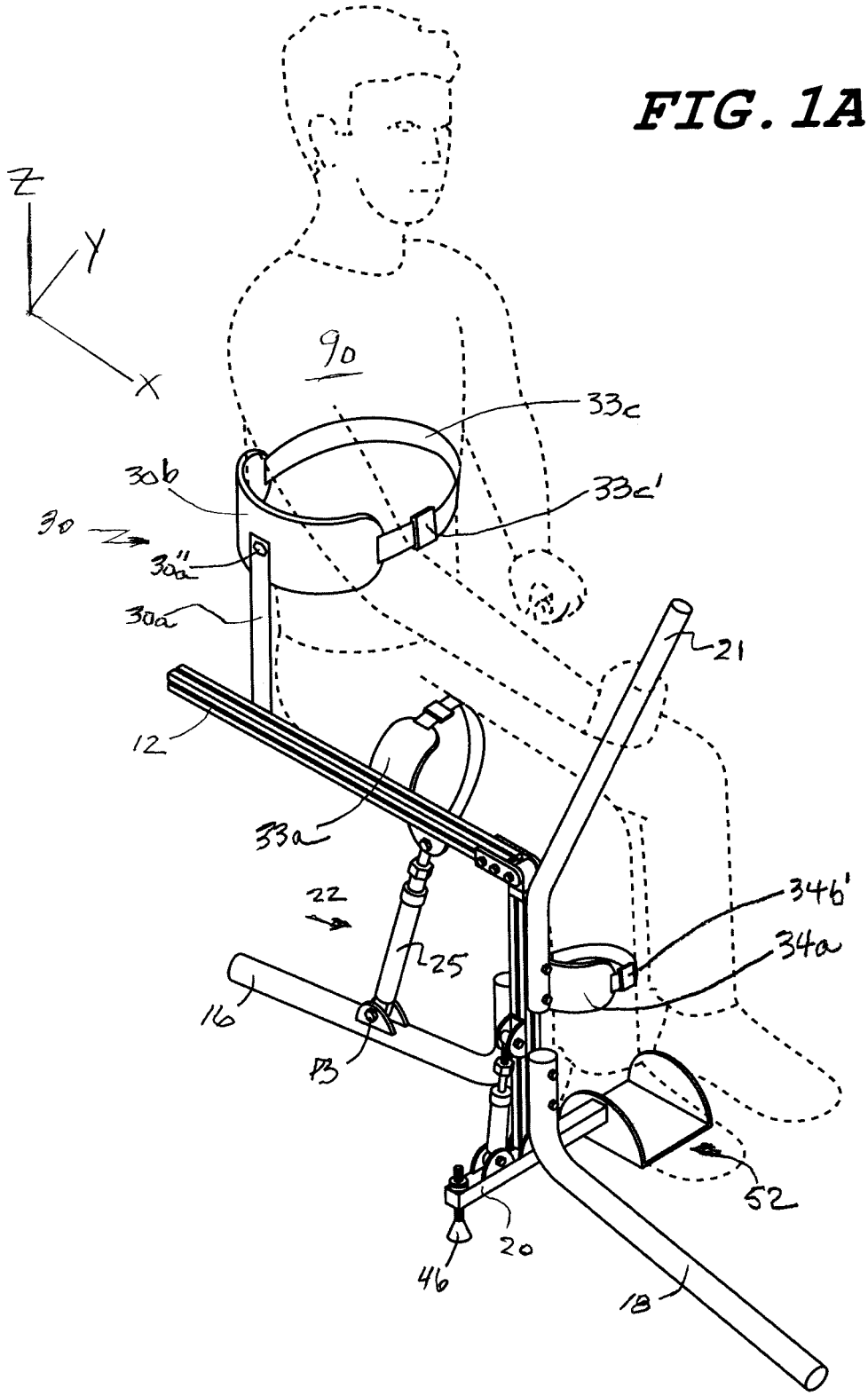
FIG. 1A is a perspective view of one embodiment of an assisted standing and walking device of the present invention with a user attached to the device ready for use in one example of a sitting position.
Figure 1B:
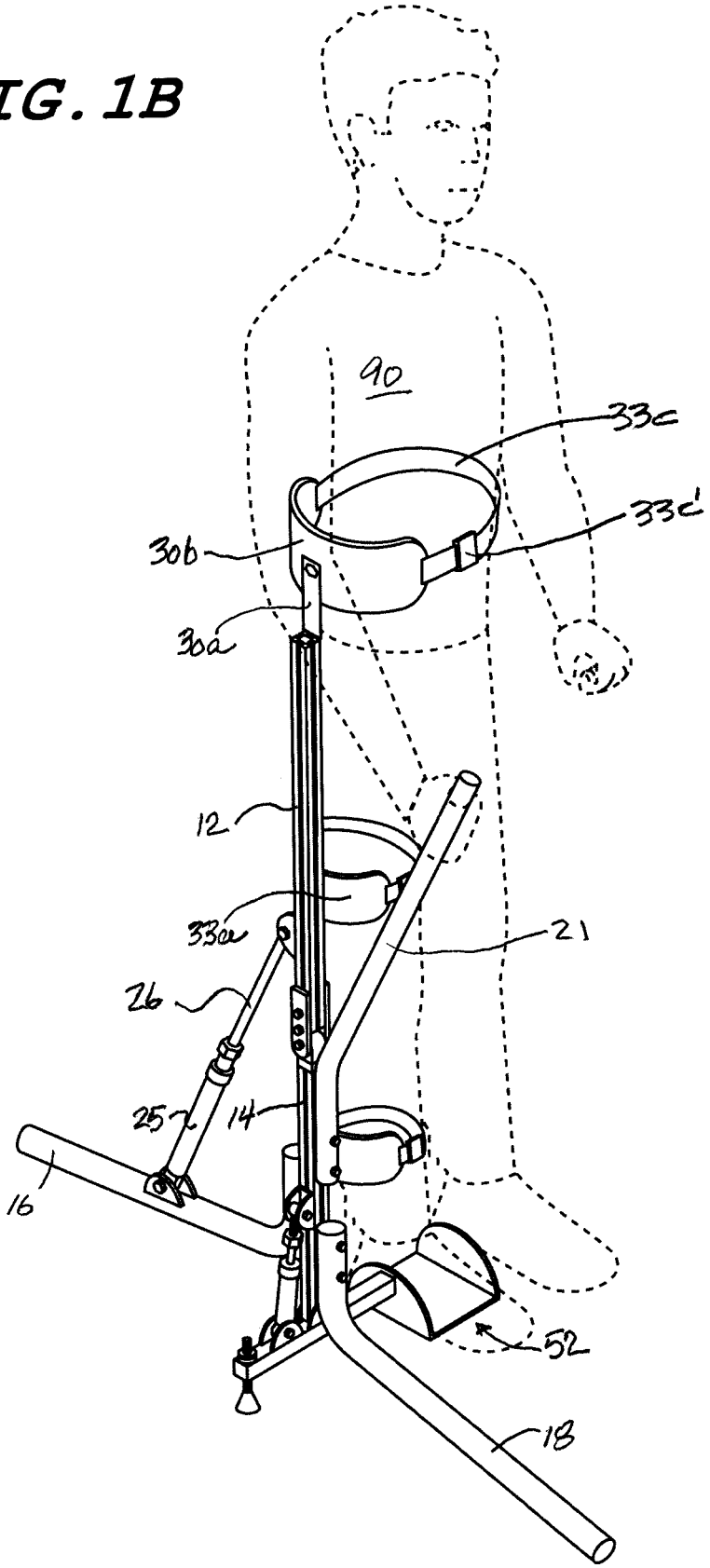
FIG. 1B is a perspective view of one embodiment of an assisted standing and walking device of the present invention with a user attached to the device ready for use in a vertical standing and walking position.

Three-dimensional Cartesian space is established in the drawings for convenience of describing relative locations and movements of the disclosed assisted standing and walking device's components.

There is shown in FIG. 1A through FIG. 6 one embodiment of an assisted standing and walking device 10 of the present invention. By way of example and not limitation, one embodiment of the assisted standing and walking device 10 of the present invention has typical dimensions as indicated below for an adult user.

Upper support rod 12 provides attachment for an upper body attachment assembly 30, thigh attachment assembly 33 and upper transition pivotal revolute joint P4 for body transition assist assembly 22. Typical, but not limiting, overall linear length of upper support rod 12 is 20 inches +/−6 inches.

Figure 2A:
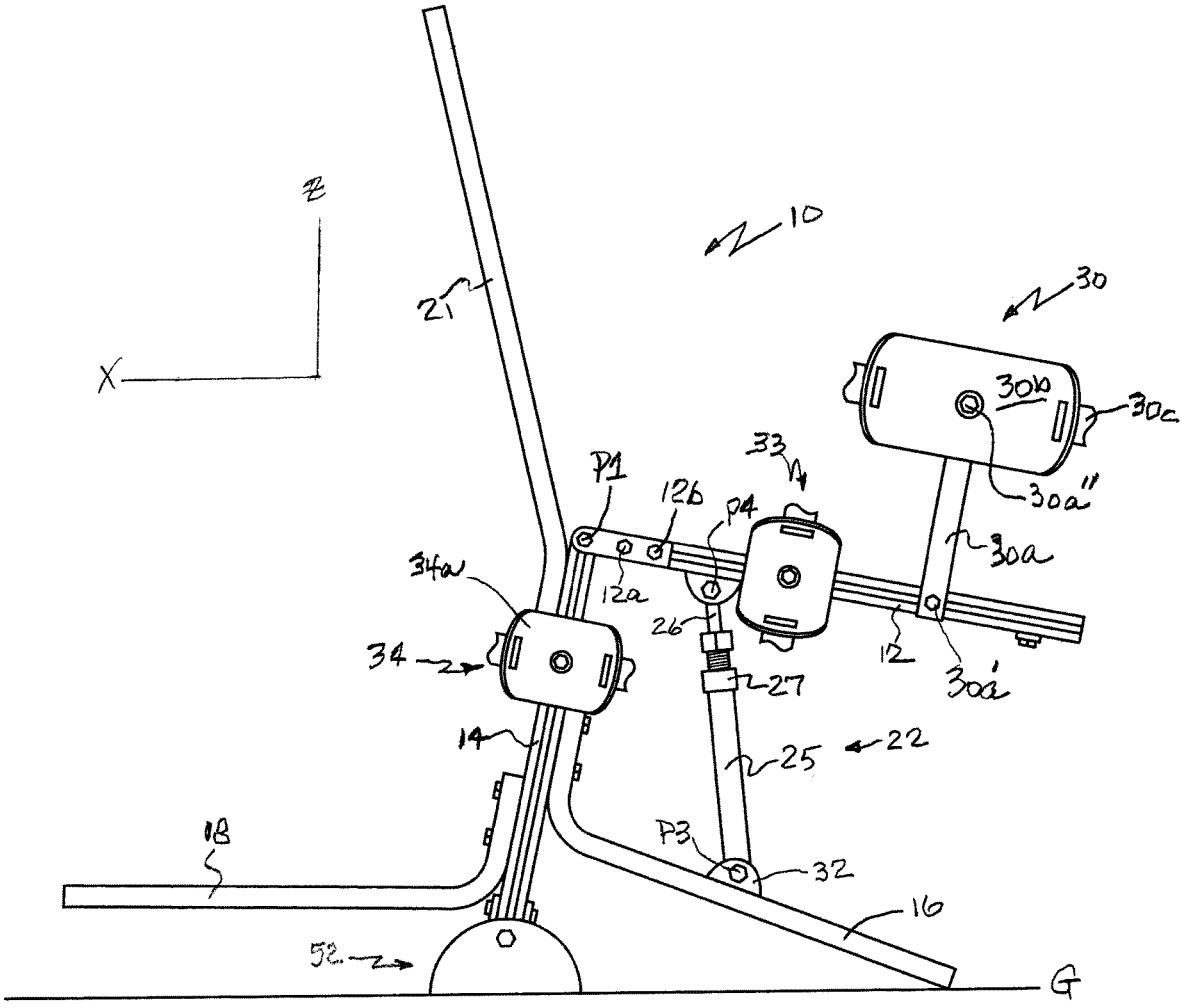
FIG. 2A is a side elevational view of one embodiment of an assisted standing and walking device of the present invention in one of the positions for a seated user after attachment to the device.
Figure 2B:
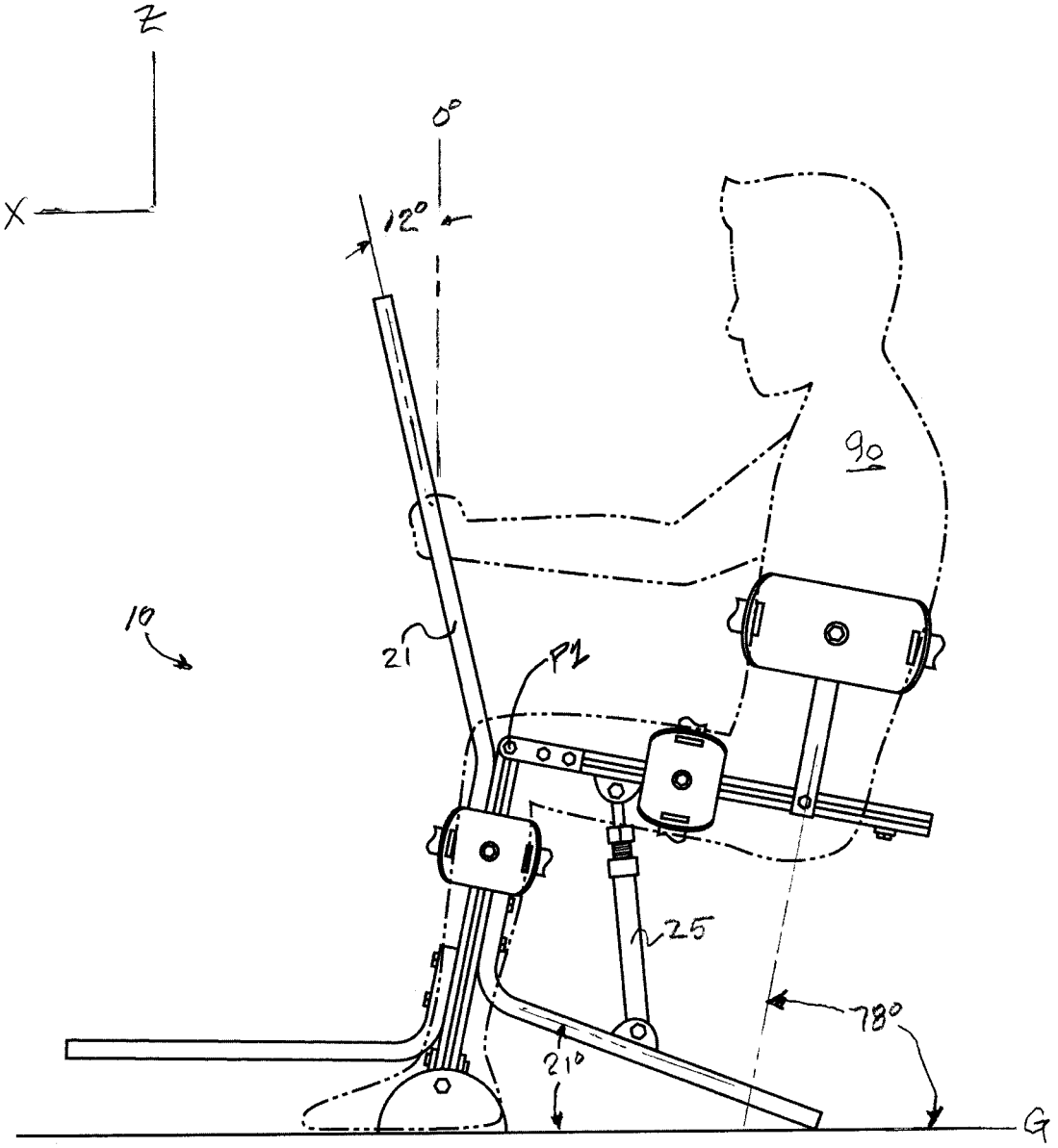
FIG. 2B is a side elevational view of the assisted standing and walking device of the present invention in FIG. 2A with a user attached to the device in the sitting position without a chair being shown for clarity of the device.
Figure 3A:
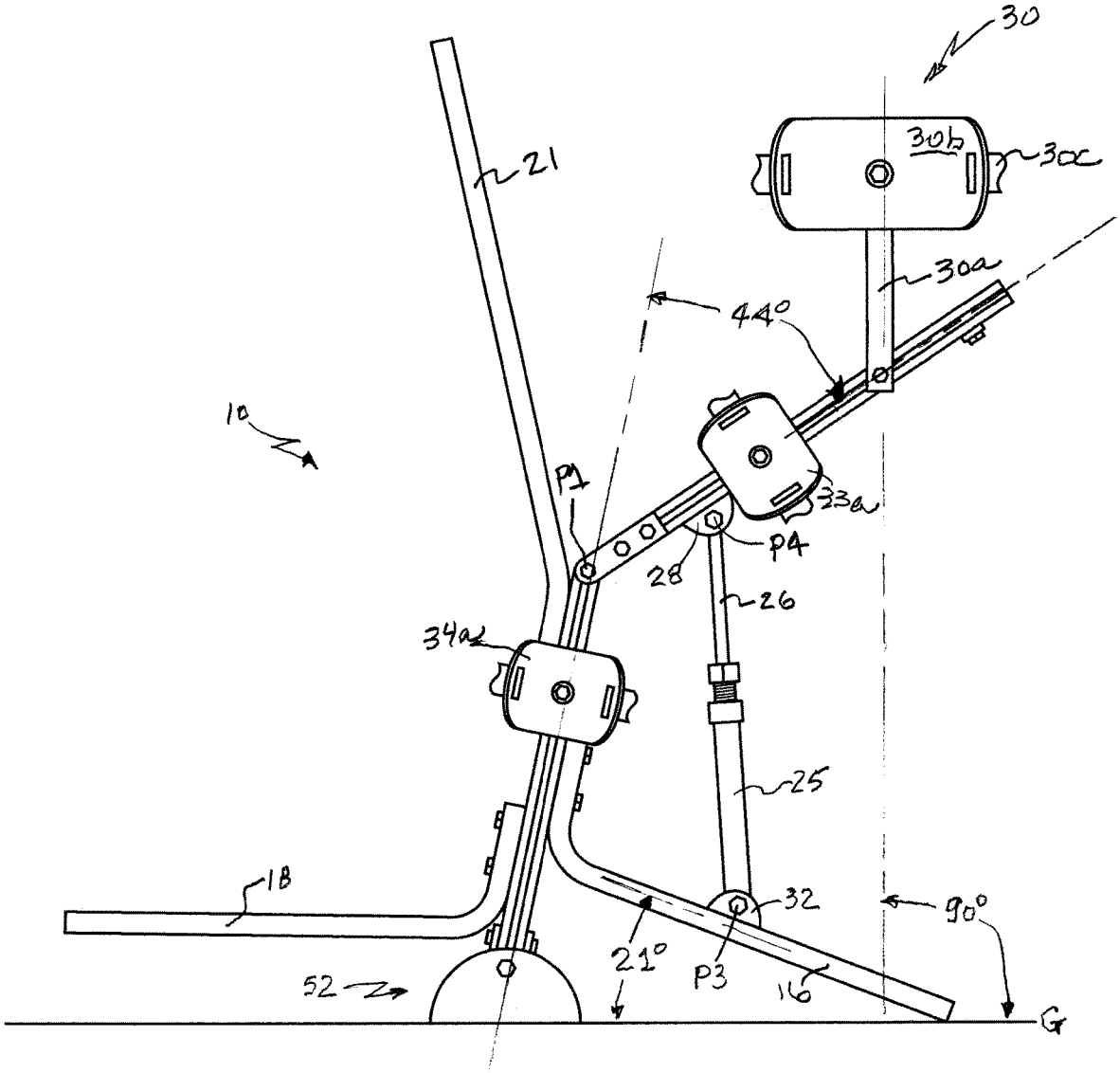
FIG. 3A is a side elevational view of the assisted walking device in FIG. 2A after the device transitions from the user seated position in FIG. 2A to one of a series of user mid-transition device positions between the user seated position in FIG. 2A and the vertically upright user device standing position in FIG. 4A or vice versa.
Figure 3B:
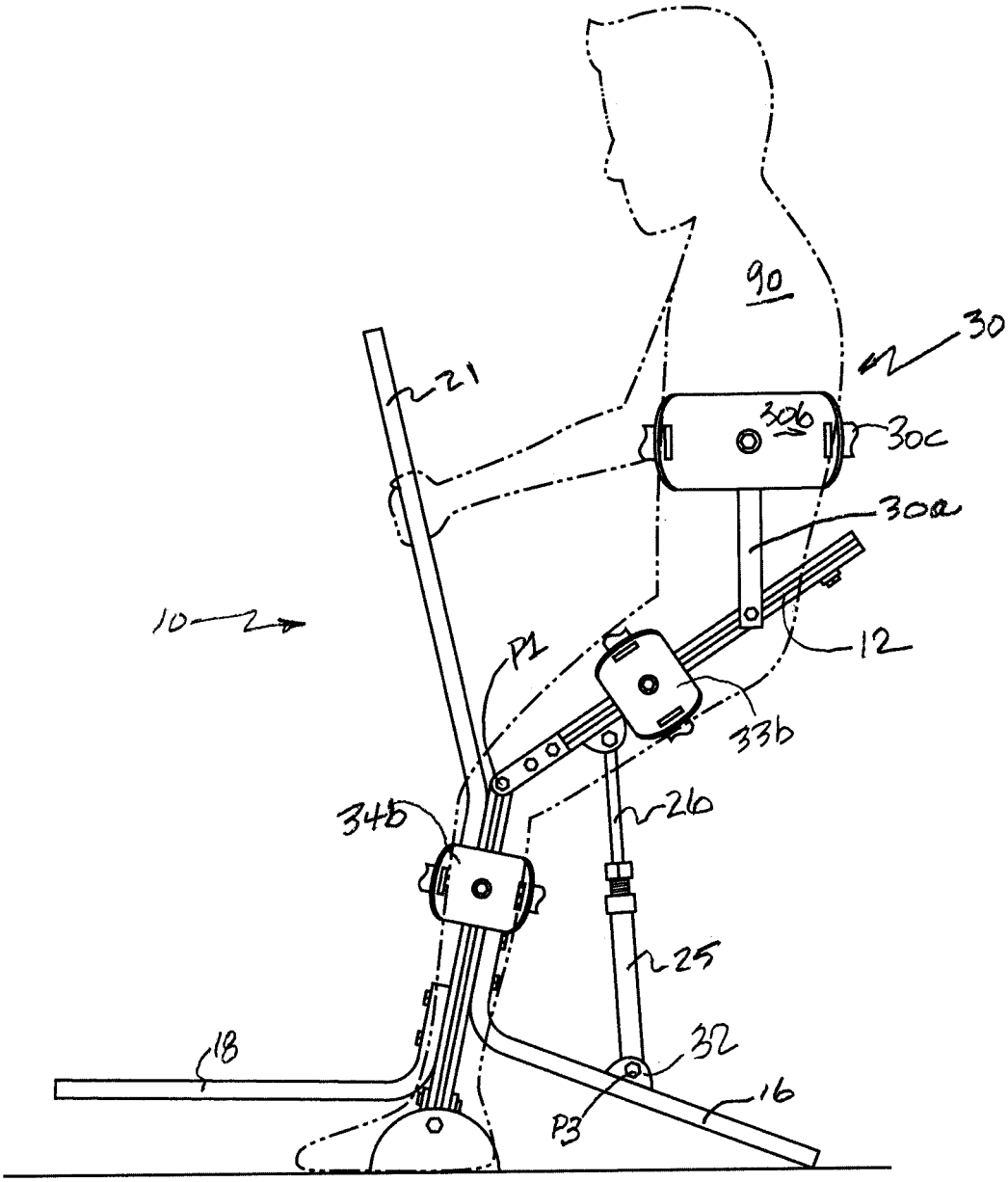
FIG. 3B is a side elevational view of the assisted walking device in FIG. 3A with a user attached to the device in one of a transition positions between the sitting position and standing position.

Lower support rod 14 provides attachment for below knee attachment assembly 34, body transition grab bar 21, backwards motion stop rod 16 and forward motion stop rod 18. Typical, but not limiting, overall linear length of lower support rod 14 is 13 inches +/−6 inches. Lower support rod 14 is pivotally attached to upper support rod 12 by pivotal revolute joint P1. In some embodiments of the invention pivotal revolute joint P1 is configure with mechanical stops that limit joint P1 rotation between the upper support rod and the lower support rod from vertical (180 degrees) when user 90 is in a standing position (FIG. 4B) to 89 degrees when user 90 is in lowest seated position (FIG. 2B in the illustrated example). Generally full length of piston rod 26 in the standing position (FIG. 4B) determines limit of rotation for pivotal joint P1.

Figure 4A:
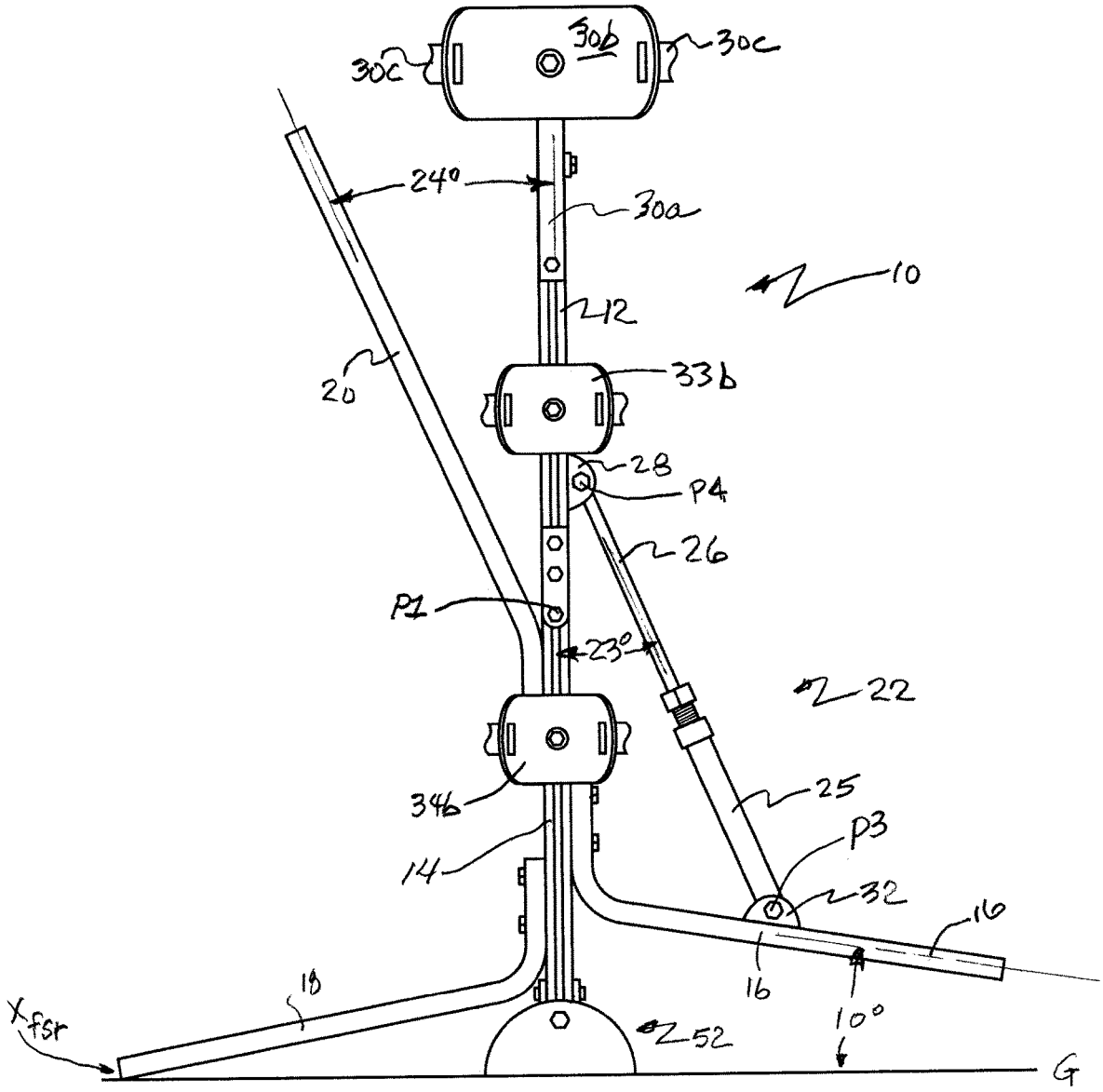
FIG. 4A is a side elevational view of the assisted standing and walking device in FIG. 3A after the device transitions from one of the series of user mid-transition device positions shown in FIG. 2A to a user vertically standing position in FIG. 3A when the user can walk upright in the device.
Figure 4B:
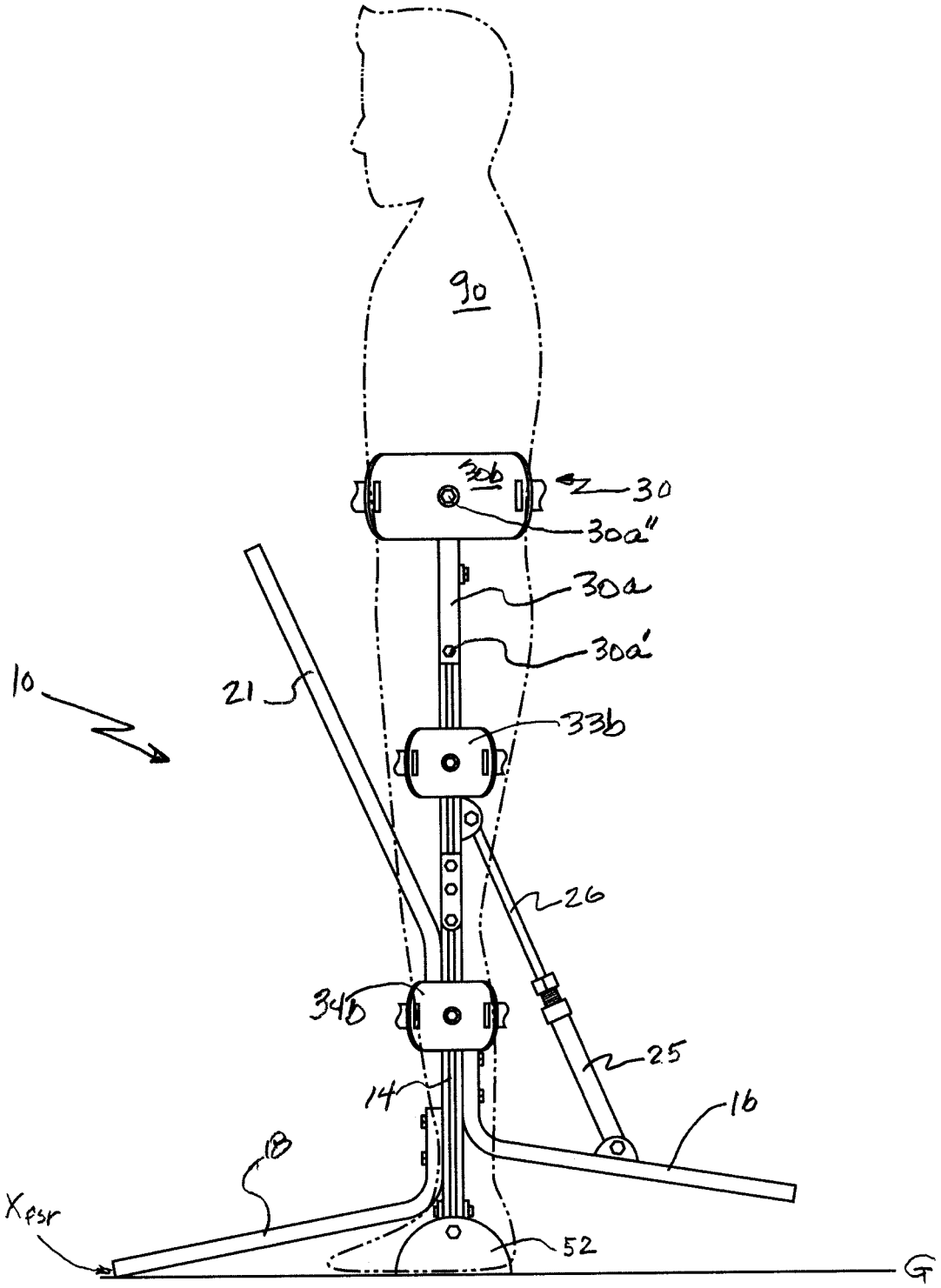
FIG. 4B is a side elevational view of the assisted standing and walking device of the present invention in FIG. 4A with a user attached to the device in the standing and walking.

The extended trailing end of backwards motion stop rod 16 rests on a level walking surface G when device 10 is in the sitting position and transition positions, and raises above the level walking surface G in transition positions as the vertical standing and walking position is reached (FIG. 4B). Typical, but not limiting, overall linear length of the backwards motion stop rod 16 is 16 inches +/−2 inches extending from lower support rod 14 to its trailing end. Backwards motion stop rod 16 provides attachment for lower transition revolute pivotal joint P3 for body transition assist assembly 22.

The forward motion stop rod 18 remains above the level walking surface G when in the sitting and transition positions and lowers to a minimal distance Xfsr (for example, 1 inch or less in one example of the invention) above the level walking surface G in the vertical standing and walking position so that it will make contact with the walking surface if user 90 begins to accidently fall forward while in the standing and walking position to prevent an accidental forward fall; otherwise the minimal is maintained to allow normal forward walking. Typical overall linear length of the forward motion stop rod 18 is 16 inches +/−2 inches extending from the lower support rod 14 to its leading end.

One or more of the body transition grab bar 21, forward motion stop rod 18 and backwards motion stop rod 16 may be configured with a tubular or rectangular cross-sectional shape. Further one or more of the body transition grab bar, forward motion stop rod and backwards motion stop rod may be configured with an adjustable length, for example, by providing multiple telescoping lockable at different lengths by the user to accommodate different user physiques.

Body transition assist assembly 22 provides a lifting force to upper support rod 12 when the user pushes forward on body transition grab rod 21 to transition from a sitting position to a standing position. When the user transitions from a standing position to a sitting position, body transition assist assembly 22 provides a damping resistance force to upper support rod 12 as the user pulls backwards on body transition grab rod 21. In some embodiments of the invention body transition assist assembly 22 has a lock and unlock device for the user to lock and unlock piston rod 26 in a user selective position anywhere between a sitting position (piston rod 26 fully retracted into cylinder 25) and a standing and walking position (piston rod 26 fully extended from cylinder 25) with a lock and unlock control lever mounted on body transition assembly 22.

U.S. Pat. No. 8,151,812 describes one example of an assembly that can be adopted for use as a body transition assist assembly 22 in the present invention. U.S. Pat. No. 8,151,812 is incorporated herein by reference in its entirety. With reference to drawing reference numbers in U.S. Pat. No. 8,151,812 that are identically used in the present application, as shown in the attached figures herein, components of body transition assist assembly 22 comprise body weight support gas spring or a charged preloaded gas cylinder 25; piston rod 26 and lock and unlock control lever 31 in U.S. Pat. No. 8,151,812.

In the present invention, U-shaped connector 28 that is connected to upper support rod 12 forms revolute pivotal joint P4 and U-shaped connector 32 that is connected to rearwards motion bar 16 forms revolute pivotal joint P3. Generally positioning of cylinder 25 and piston rod 26 is such that in the standing and walking position shown in FIG. 4A piston rod 26 is fully extended from gas cylinder 25 in FIG. 4A and in the sitting position shown in FIG. 2A piston rod 26 is fully retracted into gas cylinder 25 in FIG. 2A.

Generally in operation initial rising of the user's body from the seated position in FIG. 2B can be provided by the body transition assist assembly 22 until piston rod 26 is fully extended from gas cylinder 25 and if necessary, the user pulls forward on grab bar 21 until in the standing and walking position in FIG. 4B.

In some embodiments of the invention, piston rod 26 is configured with a control lever for the user to lock or unlock piston rod 26 to respectively lock assisted standing and walking device 10 in any position between and including the sitting position, through all transition positions, and the standing and walking position. In one example of the invention, piston rod 26 is operable configured with control lever 31 as shown in FIG. 7A and FIG. 7B of U.S. Pat. No. 8,151,812 which is incorporated herein by reference in its entirety. Control shaft 37 is connected to control lever 31 at one end and extends at its other end onto the surface of, or through, opening 39 of off center circular disk 36. The contact point of control lever shaft 37 onto the surface of the off center circular disk 36 or opening 39 of off center circular disk 36 is not at the center point of off center circular disk 36 but rather is at an off center location of disk 36. Locking screw 38 clamps down control lever shaft 37 to off center circular disk 36. When moved, control lever 31 travels in a circular arc which rotates control lever shaft 37 which in turn rotates off center circular disk 36. As off center circular disk rotates in an off center fashion it either compresses or releases gas control pin 35. When the control lever is turned to an activated release position off center circular disk moves gas control pin 35 disposed adjacent to and in physical contact with off center circular disk 36. Upon activation, the gas control pin's movement releases the pressurized gas for movement within sealed chamber 66 of the gas cylinder 25. The pressurized gas exerts a force upon the piston causing the piston to extend out from the gas cylinder. When the pressurized gas is available to move within the chambers of the sealed gas cylinder the piston can move within the cylinder in response to the force applied by the user as shown in FIG. 15 of U.S. Pat. No. 8,151,812. As a result, assisted standing and walking device 10 and the user can move in an upward direction to the standing and walking direction or downward direction to the sitting position and can optionally provide partial weight bearing support.

When the user desires to immobilize standing and walking device 10 from up (to standing and walking position) and down (to sitting position) movement or desires full weight support, control lever 31 is rotated so that off center circular disk 36 releases the pin from the activated position to a closed or locked position. In the closed or locked positioned pin 35 limits the movement of the gas within the gas cylinder 25 as shown in FIG. 16 of U.S. Pat. No. 8,151,812. In the locked rigid position, the piston rod 26 is immobilized and will not retract into or extend from the gas cylinder in response to the force applied by the user. Thus the user in device 10 and assisted standing and walking device 10, which are supported by the gas spring's position, are likewise maintained in a fixed stationary position.

When control lever 31 is turned to the activated released position the pressurized gas transmits its force through the piston rod to provide partial weight bearing support to the user or in some circumstances full weight bearing support. The user, with the aid of partial weight support, can exerts his or hers own muscular effort in the legs and torso as may be available to help support his or hers transitioning from a sitting position to a standing position or vice versa. The user can let his or her body weight push the device 10 down against the gas spring's supporting (damping) force to an elevation desired for sitting and then lock the gas spring into place which locks the piston rod in position. This allows the user to disconnect from the assisted standing and walking device with the device in a fixed stationary position and without the device's body transition assist assembly 22 from exerting an upward force upon the user and risk destabilizing the user.

In general the user can turn the control lever to the locked position whenever the user desires to rest whether in the standing position, partially standing (transition position) or sitting position while attached to device 10. Similarly when transferring from a sitting position, the user can turn control lever 31 to the activated release position when the user desires partial weight bearing support to lift himself or herself to the standing position or partially standing (transition) position and intends to use his or her own efforts to the extent he or she is able to assist in standing or walking to partially support himself or herself on his legs with any available body strength. The user can switch control lever 31 back and forth between the unlocked (released) and locked positions and move from a sitting to a standing or partially standing (transition) position which is either in a locked fully supported state or a dynamic partial weight support state and is not simply letting the device passively support him or her.

The user attached to device 10 can transition from a standing to a sitting position by letting his or her weight gradually lower himself or herself while receiving partial weight bearing support from body transition assist assembly 22. The user can then turn control lever 31 to the locked position while sitting attached to device 10 to safely disconnect from the device.

Upper support rod 12 and lower support rod are configured for the attachment of the components of device 10 as shown in the figures. In some embodiments of the invention, the upper support rod 12 and lower support rod may be of a fixed overall length as required for a particular user of device 10. In some embodiments of the invention, upper support rod or lower support rod 14 is a linear length of rectangular extruded aluminum T-slot structural frame configured for use with interlocking fittings for attachment of the components as disclosed herein. In other embodiments, the upper support rod or lower support rod is adjustable in overall length; for example, by being formed from two or more tubular sections that telescope into and out of each other to a lockable variable length as required by a particular user. In some embodiments of the invention, the upper support rod or the lower support rod may include one or more curved sections to accommodate a particular user's body shape or posture.

An upper body attachment assembly 30 is attached to the upper support rod 12 and is either fixed in location to the upper support rod with a suitable upper body retaining fastener or configured for fixing to an adjustable location along the length of the upper support rod with a fastener tightening element that can be located relative to the interior or exterior of the upper body retaining fastener. In some embodiments of the invention, the attachment of the upper body attachment assembly 30 to upper support rod 12 allows rotation of the upper support rod around the attachment in an X-Z plane when the device 10 is in use so that the vertical support rod rotates independent of the attached upper body attachment assembly. Upper body attachment assembly 33 extends at least partially around the girth of a user's chest or rib cage region to secure the user in the forward (+X) walking direction and rearward (−X) standing direction when walking with the device.

In some embodiments of the invention, as illustrated in the drawings, upper body attachment assembly 30 comprises a standoff bar 30*a* that is rotatably (in the X-Z plane) attached at a first end to upper support rod 12 by fastener 30*a*' and rotatably (in the X-Z plane) attached at a second end to arcuate shaped upper partial body retainer 30*b* by fastener 30*a*". Fastener 30*a*' also allows adjustable locking of the thigh attachment assembly along the length of the upper support rod to accommodate physiques of different users. Partial body retainer 30*b* can be formed as an arcuate shaped soft injection molded polymer material with expanding elasticity to comfortably secure a variable range of chest girths where the upper body attachment assembly is positioned when in use. In some embodiments of the invention, as illustrated in the drawings, optional chest belt 33*c* is attached to opposing ends of partial body retainer 30*b*, and is either of adjustable length or fixed length, and configured with a belt fastener 30*c*', such as a snap-fit buckle so that the upper body attachment assembly remains firmly attached to the user's chest or rib cage region when standing or walking by securing the upper body attachment assembly 30 around the entire girth of the user.

Thigh attachment assembly 33 is formed from partial thigh retainer 33*a* that is attached to upper support rod 12 by fastener 33*a*' that allows adjustable locking of the thigh attachment assembly along the length of the upper support rod to accommodate physiques of different users so that the thigh attachment assembly can be attached approximately around the girth of the mid-thigh region. The partial thigh retainer 33*a* may be former from material similar to that used for the partial body retainer. Thigh belt 33*b* is attached to opposing ends of partial thigh retainer 30*a*, and is either of adjustable length or fixed length. Thigh belt 33*b* is configured with belt fastener 33*b*', such as a snap-fit buckle so that the thigh attachment assembly remains firmly attached to the user's thigh region when standing or walking by securing the thigh attachment assembly around the entire girth of the user's thigh of the paralyzed or weakened leg.

Below knee attachment assembly 34 is formed from partial below knee partial retainer 34*a* that is attached to lower support rod 14 by fastener 34*a*' that allows adjustable locking of the below knee attachment assembly along the length of the lower support rod to accommodate physiques of different users so that the below knee attachment assembly can be attached approximately around the girth of the leg region below the knee cap and above the ankle. The partial below knee retainer 34*a* may be former from material similar to that used for the partial body retainer. Below knee belt 34*b* is attached to opposing ends of partial below knee partial retainer 34*a*, and is either of adjustable length or fixed length. Below knee belt 34*b* is configured with belt fastener 34*b*', such as a snap-fit buckle so that the below knee attachment assembly remains firmly attached to the user's below knee region when standing or walking by securing the below knee region attachment assembly around the entire girth of the user's leg region somewhere below the patella and above the ankle of the paralyzed or weakened leg.

Figure 6:
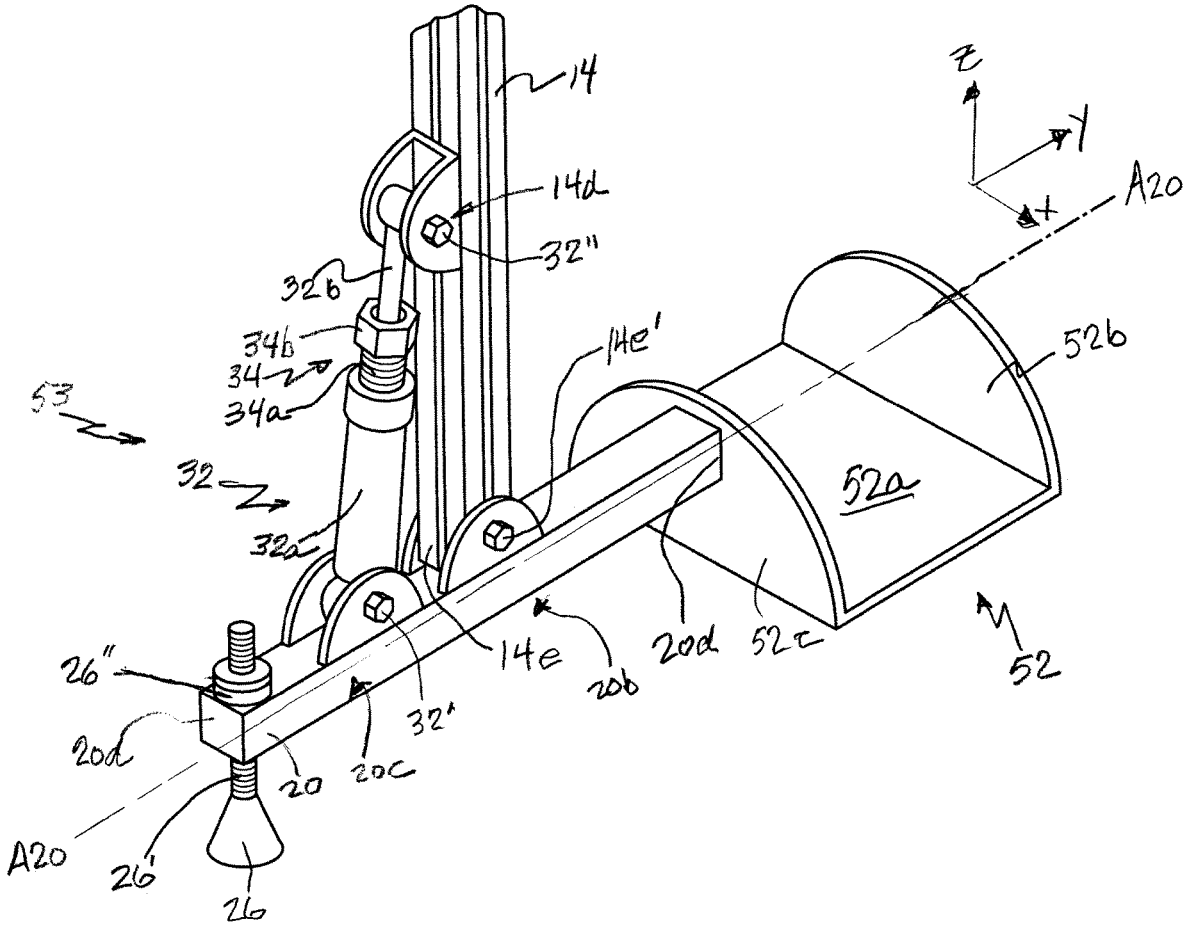
FIG. 6 is a detailed view of the limited controlled lateral gait movement assembly shown in FIG. 5A and FIG. 5B.

As best seen in FIG. 6 lower end 14*e* of lower support rod 14 is pivotally (in the Y lateral direction) attached to lower horizontally oriented support structure 20 at rod lower revolute pivotal joint 14*e*' located along the length (in the Y direction) of lower horizontally oriented support structure 20 at approximately mid-length location 20*b* and configured to allow rotation of the lower support rod 14 in a Y-Z plane when the user is walking with assisted standing and walking device so that the user can experience normal lateral gait motion during a gait cycle. Rod lower revolute pivotal joint 14*e*' is either fixed at location 20*b* of the lower horizontally oriented support structure 20 or configured for fixing to an adjustable location along the length (Y direction) of the lower horizontally oriented support structure 20 with a rod lower end fastener tightening element provided in combination with rod lower revolute pivotal joint 14*e*'.

As shown in the figures, attached respectively at opposing lateral (Y-direction) ends 20*a* and 20*d* of the lower horizontal horizontally oriented support structure 20 are foot support 52 and horizontal leveler 26.

Figure 5A:
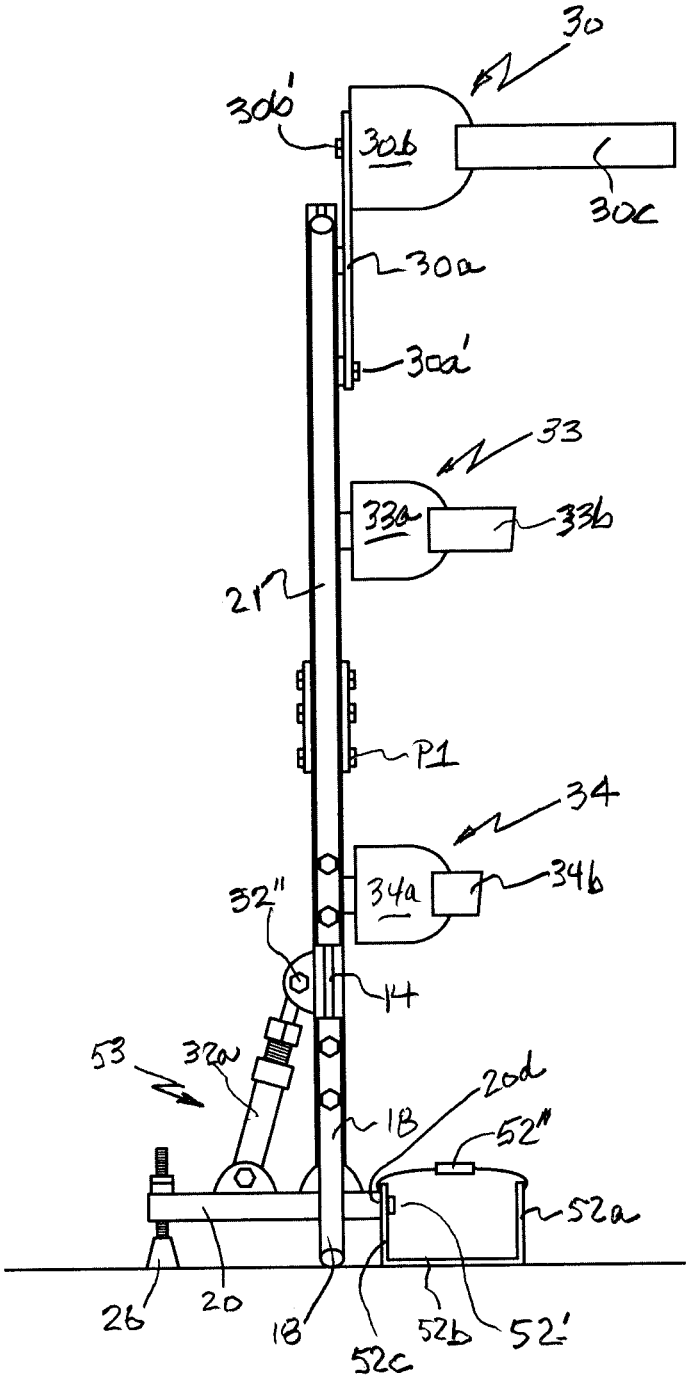
FIG. 5A is a front elevational view of the assisted standing and walking device shown in FIG. 1A to FIG. 4B.
Figure 5B:
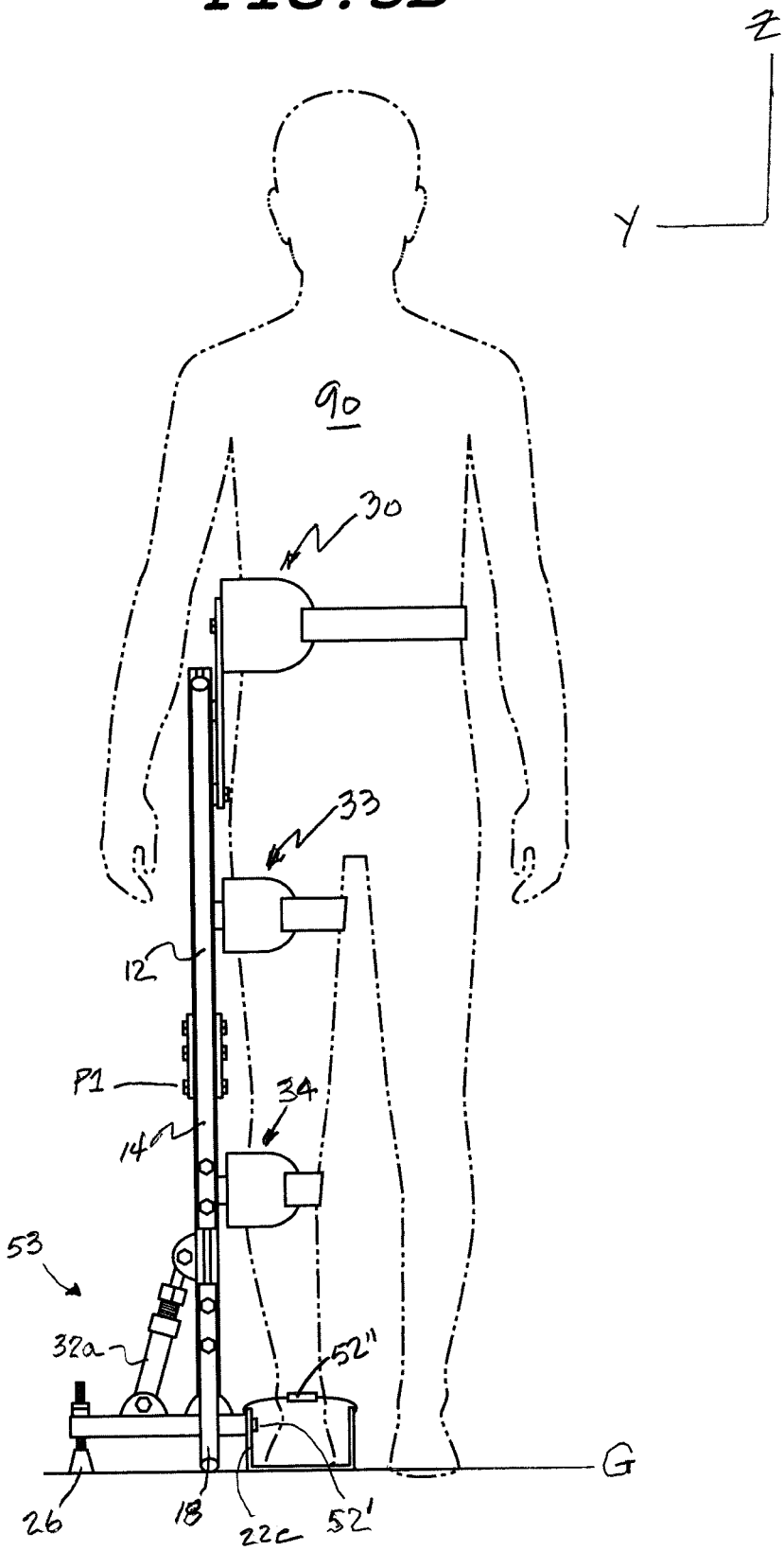
FIG. 5B is a front elevational view of the assisted walking device of the present invention in FIG. 5A with a user attached to the device in the standing position.

In some embodiments of the invention, foot support 52 for the paralyzed or weakened user's leg is configured as a foot stirrup with stirrup base 52*a* and stirrup outside and inside side walls 52*b* and 52*c*, respectively, with an open stirrup top for easy positioning of the user's leg in the stirrup and release from the stirrup. The base and side walls of the foot stirrup form a foot seating volume in which the user's foot is positioned while device 10 is in use. The inside side wall 52*c* of the foot support is pivotally attached to inner end 20*d* of the lower horizontally oriented support structure 20 by revolute pivotal joint 52' as best seen in FIG. 5B. Pivotal joint 52' is configured to allow rotation of foot support 52, with the user's foot positioned in it during use, about longitudinal axis $A_{20}$ of lower horizontally oriented support structure 20 in an X-Z plane independent of the horizontally oriented support structure 20. The base and side walls of the foot support are configured so that the foot seating volume comfortably seats the user's foot in cross sectional alignment with longitudinal axis $A_{20}$ when the user is walking in device 10 so that the user experiences a normal gait cycle movement of the foot when walking with the assistance of device 10.

In other embodiments of the invention, foot support 52 is footwear, for example, an athletic shoe. The foot support, for example the stirrup or footwear, can be manufactured by computer integrated design and manufacturing methods known in the art and can be provided with a complimentary fastening element that joins to a complimentary fastening element at inner end 20*d* of the horizontally oriented support structure 20 to form pivotal joint 52' at inner end 20*d* to provide the user's foot movement as disclosed when the foot support, for example a foot stirrup or footwear, is being used.

Lower support rod 14 and lower pivotal joint 14*e*' allows lower support rod 14 to rotate in a Y-Z plane when the user's paralyzed or weakened side is positioned in upper body attachment assembly 30, thigh attachment assembly 33, below knee support assembly 34 and foot support 52 with lateral direction gait movement that would naturally occur in a normal human gait walking cycle if device 10 was not being used. However if this lateral direction gait movement is overextended, the user would be susceptible to falling laterally (Y-direction) without the ability to recover to upright position due to the at least one-sided paralysis or weakness. To aid in avoiding lateral falling while allowing a controlled angle of gait rotation in lateral (−Y direction) device 10 includes an active lateral gait force limit assembly. In some embodiments of the invention, the active lateral gait force limit assembly is a mechanical damper, for example a dashpot, or a pneumatic or hydraulic damper, as known in the art, in combination with a lateral motion limit device. In the embodiment of the invention shown in the figures, pneumatic or hydraulic damper 32 is shown with monotube or twin tube gas or hydraulic cylinder 32*a* with damper rod 32*b* extending externally from the cylinder through lateral motion limit device 34 as best seen in FIG. 6. In this embodiment of the invention, lateral motion limit device 34 comprises externally screw threaded pipe 34*a* joined at the end of the cylinder from which damper rod 32*b* extends and threaded lateral motion limit nut 34*b* that is adjustably screwed onto externally screw threaded pipe 34*a*. The final adjusted fixed position of nut 34*b* along the screw thread determines the maximum permissible lateral gait angle on the paralyzed or weakened side of the user. In the embodiment of the invention for assisted standing and walking device 10 as shown in the figures, the cylinder end opposite the end of the externally extended cylinder rod 32*b* is pivotally (in the Y lateral direction) attached to lower horizontally oriented support structure 20 by damper revolute pivotal joint 32' located along the length of lower horizontally oriented support structure 20 at location 20*c*, which is laterally outward of the rod lower end pivot joint 14*e*'. The externally extended end of damper rod 32*b* is pivotally (in the Y direction) attached to lower support rod 14 by damper pivotal joint 32" located along the length of the lower support rod 14 at location 14*d* below the location at which below knee attachment assembly 34 is located.

When lower support rod 14 is at vertical (oriented parallel with the Z-axis), as shown for example in FIG. 5B, damper 32 is configured so that cylinder rod 32*b* is at fully extended (external) stroke. When a user walks with device 10, during gait cycle lateral (Y) motion to the right side of vertical (the side of paralysis or weakness in this example), externally extended damper rod 32*b* is forced into cylinder 32*a* to a maximum lateral gait angle when the external end of damper rod 32*b* makes contact with threaded lateral motion limit nut

34*b*. Consequently the user's lateral (−Y direction) gait motion is limited to the maximum lateral angle that is established by the final adjusted position of the threaded lateral motion limit nut 34*b* on the externally screw threaded pipe, and externally extended damper rod 32*b* will return the vertically oriented support rod 12 to vertical orientation as the user returns to zero degrees (Z direction) lateral gait angle when the lower support rod 14 is at vertical orientation.

Horizontal leveler 26 is attached to outer end 20*d* of lower horizontally oriented support structure 20 and is either fixed in vertical (Z direction) distance from the bottom of the lower horizontal support structure to level walking surface G, or configured for secured fixing to an adjustable vertical distance with a leveler fastener tightening element that can be located above or below the lower horizontal support structure, such as adjustable threaded rod 26' attached to leveler 26 and nut 26" attached to the horizontally oriented support structure. In some embodiments of the invention, horizontal leveler 26 is bell-shaped and maintains the lower horizontally oriented support structure horizontally oriented as the user moves through a gait cycle. In some embodiments of the invention, horizontal leveler 26 is formed from a soft high elasticity polymer that is a passive lateral (Y) direction damper that functions in conjunction with the active lateral gait force damper to limit lateral gait motion.

The above examples of the invention describe assisted standing and walking devices for a right-side paralysis or weakness. Assisted standing and walking devices for a left side paralysis or weakness of the present invention are mirror images of those disclosed for right side paralysis or weakness.

Figure 7:
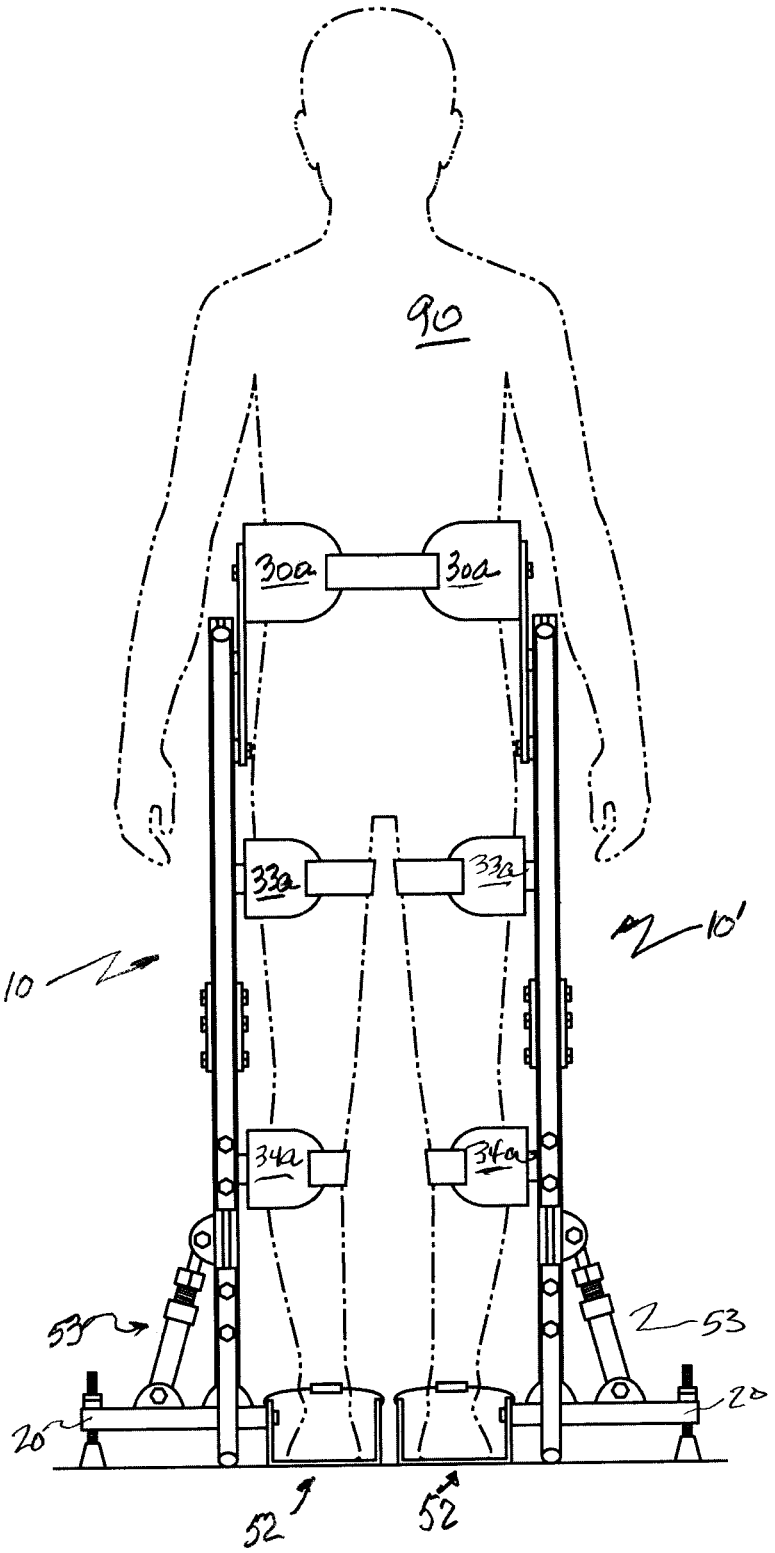
FIG. 7 is a front elevational view of a double-sided assisted standing and walking device of the present invention.

In some applications of the invention a single right side or a single left side walking device of the present invention may be sufficient for use by a paraplegic. In other applications of the invention a combined right and left side walking device of the present invention may be used by a paraplegic to form an assisted walking device of the present invention for use by a paraplegic. One embodiment of a double-sided assisted standing and walking device 11 of the present invention is illustrated in FIG. 7 which is a combination of a right-side assisted standing and walking device 10 and a mirror image of the right-side assisted standing and walking device 10' that forms the left side assisted standing and walking device.

In some embodiments of the invention, one or more of the components forming the assisted walking device can be formed as a unitary structure fabricated from a carbon fiber reinforced polymer.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention. Those skilled in the art, having the benefit of the teachings of this specification, may make modifications thereto without departing from the scope of the invention.

The invention claimed is:

1. An assisted standing and walking device with lateral gait control for a user independently rising from a seated position and walking without an external support, the assisted standing and walking device comprising:

an upper support rod;

an upper body retainer attachment assembly adjustably connected to the upper support rod;

a thigh attachment assembly adjustably connected to the upper support rod;

an upper pivotal attachment P4 connected to the upper support rod for a body transition assist assembly;

a lower support rod;

a below knee attachment assembly adjustably connected to the lower support rod;

a user body transition grab bar adjustably connected to the lower support rod;

a backwards motion stop rod connected to the lower support rod, the extended end of backwards motion stop rod resting on a level walking surface when in a sitting position or a transition positions and raising above the level walking surface in a standing and walking position, the backwards motion stop rod providing a lower pivotal attachment P3 for body transition assist assembly;

a forward motion stop rod connected to the lower support rod, the forward motion stop rod remaining above the level walking surface when in the sitting position and the transition position and a leading end of the forward motion stop rod lowering to a minimal distance above the level ground walking surface in the standing and walking position so that the leading end of the forward motion stop rod will make contact with the level walking surface if the user falls forward to prevent a forward fall of the user;

an upper/lower pivotal joint P1 pivotally connecting the upper support rod and the lower support rod;

a body transition assist assembly providing a lifting force to the upper support rod when the user pushes forward on a body transition grab rod to transition from the sitting position to the standing and walking position and when the user transitions from the standing and walking position to the seating position body when the body transition assist assembly provides a damping resistance force to the upper support rod as the user pulls backwards on the body transition grab rod;

an active lateral gait force limit assembly; and a foot support assembly.

2. The assisted standing and walking device of claim 1 further comprising a lock and unlock control device disposed on the body transition assist assembly for the user to selectively lock and unlock the body transition assist assembly anywhere between the sitting position through the transition position to the standing and walking position with the lifting force and the damping force inhibited in the lock position.

3. The assisted standing and walking device of claim 1 wherein the upper support rod and the lower support rod each comprises a rectangular extruded aluminum T-slot structural frame.

4. The assisted standing and walking device of claim 1 wherein the upper support rod or the lower support rod comprises at least two support rod sections adjustably interconnected to adjust the overall length of the upper support rod or the lower support rod.

5. The assisted standing and walking device of claim 1 wherein the upper support rod or the lower support rod comprises at least one curved section configured to the user.

6. The assisted standing and walking device of claim 1 wherein the upper body support assembly comprises an arcuate shaped soft injection molded polymer material having an expanding elasticity configured for a variable range of chest girths of the user.

7. The assisted standing and walking device of claim 5 wherein at least one of the upper body support assembly; the thigh attachment assembly or the below knee attachment assembly further comprises a belt configured with a belt fastener to secure the upper body support assembly; the thigh attachment assembly or the below knee attachment assembly around an entire girth of the user.

8. The assisted standing and walking device of claim 1 wherein the upper body support assembly; the thigh attachment assembly or the below knee attachment assembly is configured for an adjustable securement along the length of the upper support rod or the lower support rod.

9. The assisted standing and walking device of claim 1 wherein the active lateral gait force limit assembly comprises a mechanical damper or dashpot disposed in the lateral gait plane and connected between the lower support rod and a horizontally oriented support structure between the lower support rod pivotal attachment and the outer horizontally oriented support structure end.

10. The assisted standing and walking device of claim 1 wherein the active lateral gait force limit assembly comprises a pneumatic or hydraulic damper and a lateral gait motion limit device.

11. The assisted standing and walking device of claim 1 wherein the active lateral gait force limit assembly comprises a gas or hydraulic cylinder having an external damper rod extending from a second cylinder end to an extended damper rod end, a first cylinder end opposing the second cylinder end pivotally attached to the horizontally oriented support structure between the lower support rod pivotal attachment and the outer horizontally oriented support structure end and the extended damper rod end pivotally attached to the lower support structure to damper the lateral gait plane rotation;

an externally screw threaded pipe section disposed around the external damper rod and connected to the second cylinder end; and a thread lateral gait motion limit nut adjustably positioned on the externally screw threaded pipe section at a maximum lateral gait angle position configured to block further retraction of the external damper rod into the gas or hydraulic cylinder and thereby block further lateral gait plane rotation.

* * * * *